US006655875B1

(12) United States Patent
Pignato

(10) Patent No.: US 6,655,875 B1
(45) Date of Patent: Dec. 2, 2003

(54) PIER ADJUSTING MECHANISM AND METHOD FOR FACILITATING THE ADJUSTING AND LEVELING OF A PIER PLATFORM

(76) Inventor: Glenn Pignato, 6125 S. 030 West, Wolcottville, IN (US) 46795

( * ) Notice: Subject to any disclaimer, the term of this patent is extended or adjusted under 35 U.S.C. 154(b) by 4 days.

(21) Appl. No.: 10/230,742

(22) Filed: Aug. 29, 2002

(51) Int. Cl.[7] ..... E02D 27/00; E02D 27/50; B63C 1/00

(52) U.S. Cl. ..... 405/221; 405/244; 405/231; 52/169.9

(58) Field of Search ..... 405/221, 229, 405/231, 232, 244, 249, 251; 52/169.9, 125.1, 126.7

(56) References Cited

U.S. PATENT DOCUMENTS 4,854,782 A 8/1989 May
4,890,959 A 1/1990 Robishaw et al.
4,907,916 A 3/1990 Hartman
4,925,345 A 5/1990 McCrown, Jr. et al.
5,492,437 A 2/1996 Ortiz
6,142,710 A 11/2000 Holland, Jr. et al.
6,193,442 B1 2/2001 May
6,398,188 B1 6/2002 Salman

*Primary Examiner*—Thomas B. Will
*Assistant Examiner*—Tara L. Mayo
(74) *Attorney, Agent, or Firm*—Randall J. Knuth

(57) ABSTRACT

A pier or dock adjustment method permits adjustment of a height of a pier platform relative to a pier structure, the pier structure including at least a first post. The method includes the step of providing a platform height adjustment apparatus, the platform height adjustment apparatus including a platform support member and a height positioning mechanism. The platform height adjustment apparatus is slidably mounted on the first post. The post position of the platform height adjustment apparatus is fixed relative to the first post, the post position being situated above and proximate the pier platform. The platform support member is moved into a platform supporting position relative to the platform. The height positioning mechanism is actuated to thereby one of lower and lift the pier platform.

19 Claims, 3 Drawing Sheets

PIER ADJUSTING MECHANISM AND METHOD FOR FACILITATING THE ADJUSTING AND LEVELING OF A PIER PLATFORM

BACKGROUND OF THE INVENTION

1. Field of the invention

The present invention relates to a pier or dock adjusting mechanism, and specifically to a manually-operable lift device attachable to a pier support post for lifting and/or lowering of a pier platform.

2. Description of the related art

Piers are commonly used to provide a structure that allows people to be able to walk a distance from a shore out over a body of water, such as a lake or river. Such a pier typically includes a pier platform/pier planking upon which people can walk and a structure for supporting such a pier platform over the water. Over time, effects such as shifting of the pier support structure itself, shifting of the pier relative to the ground or subsurface in which it is mounted, and/or a change in water level may dictate a need to adjust the position of the pier platform.

Currently, such an adjustment can often require several people getting into the water to lift the pier platform and unload the pier structure, while one or more people adjust the positioning of the pier structure to achieve the needed pier placement adjustments. The reason that several people can be required to do the lifting of the pier platform is that the pier platform, depending on the size and length can weigh up to several hundred pounds. To possibly make matters even more difficult, lifting of the pier platform from the far end, where lifting might be able to be done most effectively, may not be feasible due to the depth of the water at that pier position.

What is needed in the art is a pier adjusting mechanism that will facilitate one or two people being able to adjust and level a pier platform without the need for heavy lifting and without the need to get into the water.

SUMMARY OF THE INVENTION

The present invention includes a pier adjustment mechanism that could be removably mounted to a pier post of a pier structure and be able to be used, via a manually-operated lift or jack, in much the same manner as a forklift to facilitate the lifting and/or lowering of a pier/dock platform.

The present invention, in one form thereof, relates to a pier comprising at least one post including a first post, a pier platform, a temporary support member, and a platform height adjustment apparatus. The pier platform is mounted relative to each post, the pier platform having a platform underside. The temporary support member is selectively vertically positioned upon the first post at a temporary, fixed position. The platform height adjustment apparatus is slidably mounted along the first post and rests upon the temporary support member. The platform height adjustment apparatus includes a platform support member and a height positioning mechanism. The platform support member supports the pier platform, and the height positioning mechanism is configured for facilitating a selective vertical positioning of the platform support mechanism and, therefore, the pier platform relative to the first post.

The present invention, in yet another form thereof, relates to a method of adjusting a height of a pier platform relative to a pier structure, the pier structure including at least a first post. The method includes the step of providing a platform height adjustment apparatus, the platform height adjustment apparatus including a platform support member and a height positioning mechanism. The platform height adjustment apparatus is slidably mounted on the first post. The post position of the platform height adjustment apparatus is fixed relative to the first post, the post position being situated above and proximate the pier platform. The platform support member is moved into a platform supporting position relative to the platform. The height positioning mechanism is actuated to thereby one of lower and lift the pier platform.

An advantage of the present invention is that one or two people can easily adjust and level a pier platform using the inventive apparatus.

Another advantage of the present invention is that no one needs to get into the water in order to hold up the platform while the positioning of various pier support members is adjusted.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
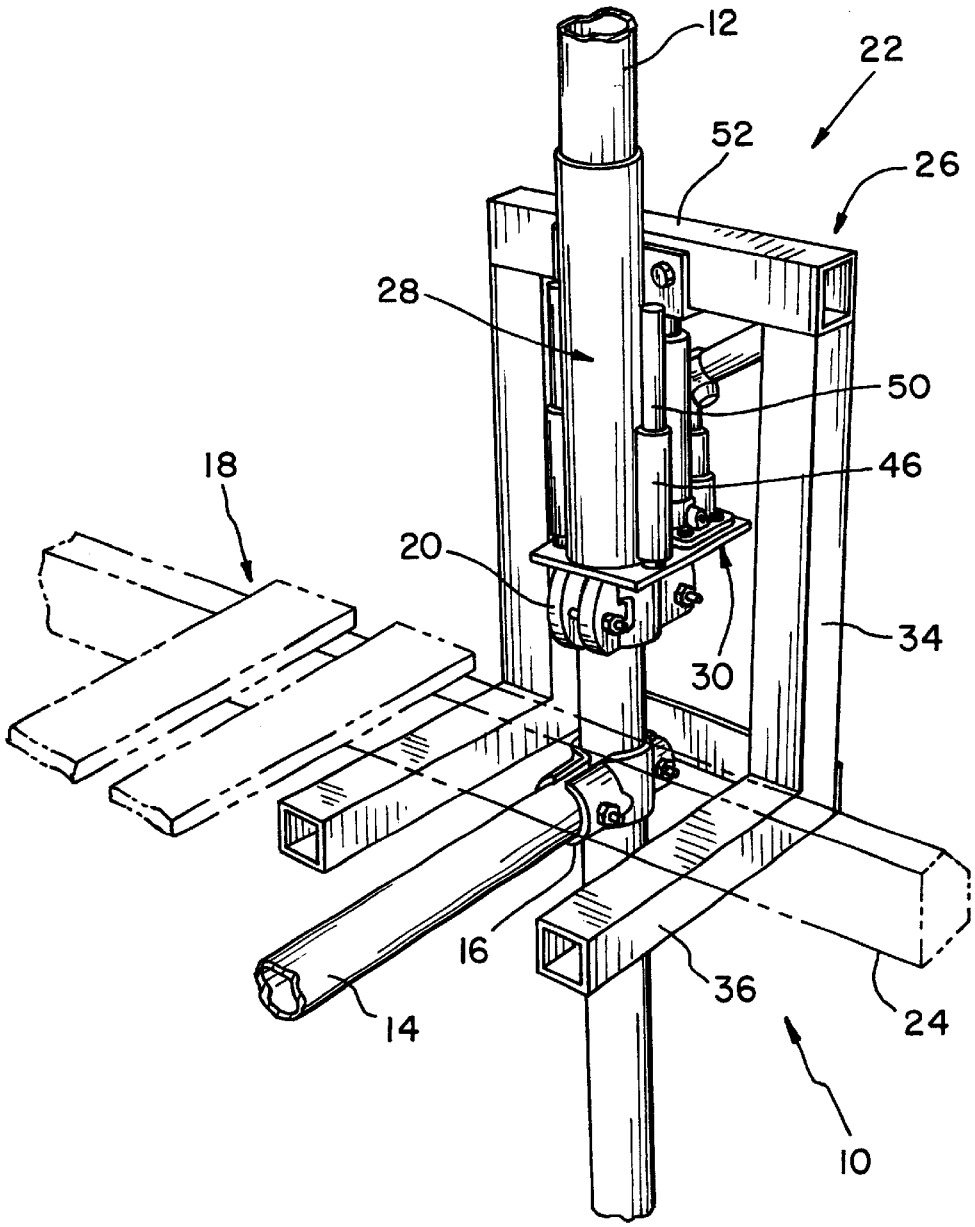
FIG. 1 is a perspective view of a pier structure employing the platform height adjustment apparatus of the present invention.
Figure 2:
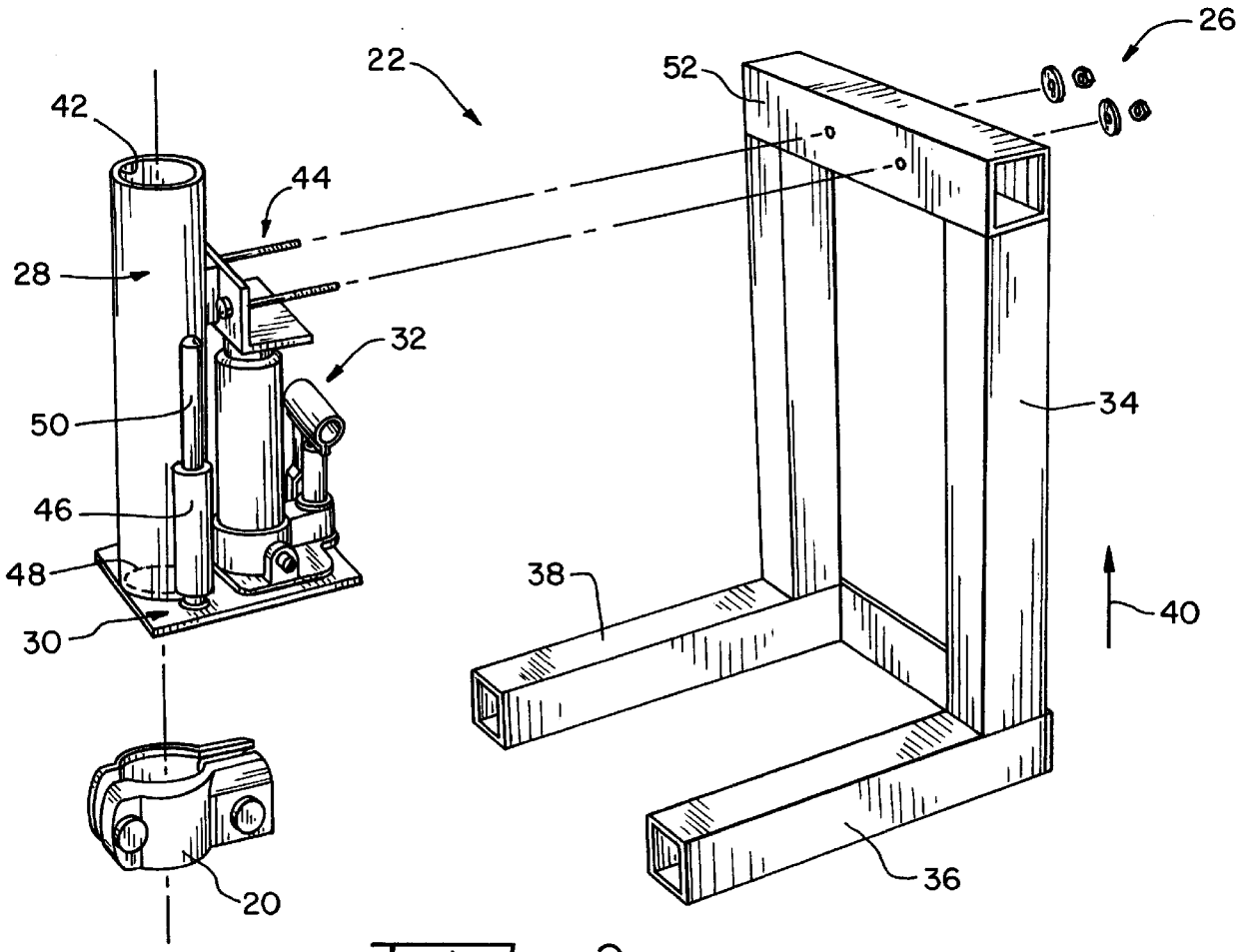
FIG. 2 is an exploded view of the platform height adjustment apparatus of the present invention.
Figure 3:
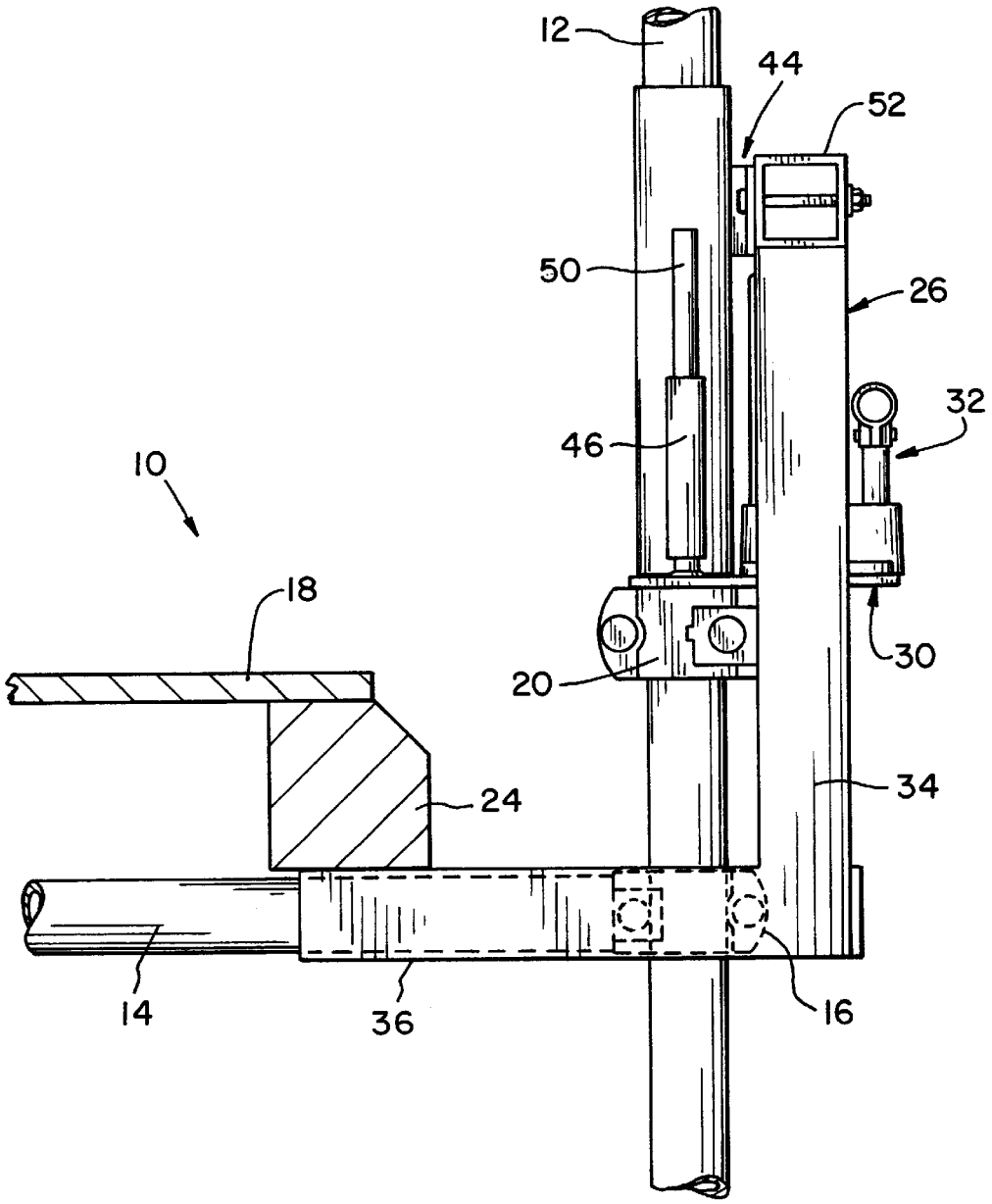
FIG. 3 is a side view of the platform height adjustment apparatus of the present invention.

As shown in FIG. 1, the present invention is directed to a pier 10 for facilitating walking out a distance from shore over a body of water (not shown). Pier 10 of the invention includes multiple posts of which only a first post 12 is shown, a cross-member 14, a cross-member receiver 16 associated with each end of cross-member 14 (one of which is shown in association with first post 12 and cross-member 14), a pier platform 18 (i.e., pier planking), a temporary support mechanism 20, and a platform height adjustment apparatus 22 (as best seen in FIGS. 2 and 3).

Posts such as first post 12 are typically vertically mounted within the ground or subsurface and extend above the water level, while each cross-member 14 is horizontally mounted between a pair of posts. Each post and cross-member may be round or polygonal in cross-section, as well as, being hollow or solid. However, it is advantageous to use piping for the posts and cross-members as piping and related pipe fittings are readily available commercially in forms that are both strong and corrosion resistant. Strength and corrosion resistance are important factors considering that the pier needs to support its own weight and that of potentially several people and is continually subject to water and other elements. As such, both factors are of great importance in developing a pier that will be long lasting.

Cross-member receiver 16 is positioned at a selected vertical post position relative to first post 12. Cross-member receivers such as cross-member receiver 16 in conjunction with cross-member 14 facilitate the support of pier platform 18 relative to the pier posts such as first post 12. Cross-member receiver 16 is selectively and adjustably positioned vertically along first post 12. Pier platform 18 has a platform underside or perimeter 24 which is able to rest upon cross-member 14.

Temporary support mechanism or member 20 is similar to cross-member receiver 16 in both structure and function except that it need not necessarily have a means for receiving a cross-member 14 therewithin. Temporary support mechanism 20 and cross-member receiver 16 are structurally similar in that they are both able to be mounted around a post at a selective position thereupon. They are functionally similar in that they both facilitate the transfer of the weight of pier platform 18, including pier underside 24, to a respective pier post. The purpose of temporary support mechanism 20 will be more readily apparent with the discussion of the structure and operation of platform height adjustment apparatus 22 (i.e., the pier adjusting mechanism).

Platform height adjustment apparatus 22 (i.e., the pier adjusting mechanism) includes a platform support mechanism 26, a post-receiving tube (or cylinder) 28, a base plate 30, and a height positioning (lifting/lowering) mechanism 32.

Platform support mechanism or member 26 of the embodiment shown in FIGS. 1–3 includes a main bracket section 34, a first (lifting) extension 36, and a second support (lifting) extension 38. Main bracket section 34 further includes an upper bracket member 52.

Main bracket section 34 has a main bracket extension direction 40 that, in use, that will be substantially aligned with the post upon which platform height adjustment apparatus 22 is mounted (i.e., first post 12). First support extension 36 and second support extension 38 are mounted opposite one another on main bracket section 34. First and second support extensions 36, 38 are mounted and positioned so as to effectively be able to function as a forklift member that may straddle both a post and a corresponding cross-member and to be able to operatively contact platform underside 24 of pier platform 18 and thereby effectively support the weight of pier platform 18 thereupon. While first and second support extensions 26, 38 are shown to be positioned at opposite corners of main bracket section 34, other support extension configurations are possible that will be within the scope of the invention. For example, only one or even three or more support extensions may be employed on a given main bracket section 34. In choosing the size, shape, number, and positioning of the support extensions to be used, the support extensions to be used must be able to sufficiently support the pier platform to be lifted therewith and the support extensions do not interfere with a post and/or cross-member during use of platform height adjustment apparatus 22. In fact, it may prove useful to use wider support extensions that can compensate for potential weak spots in the pier platform/planking/underside.

Post-receiving tube 28 has a tube interior 42 that is sized and shaped so as to facilitate the slidable mounting of platform height adjustment apparatus 22 along one of the pier posts, e.g., first post 12. Although the invention utilizes a tube for slidable guiding upon post 12, other structures such as rings or plates with holes may be equivalently utilized. Through the use of a tube 28 the invention is operative in numerous environments, possibly with differing and various post lengths.

Post-receiving tube 28 has a tube mount 44 associated therewith that permits attachment of post-receiving tube 28 to main bracket section 34 of platform support mechanism 26 while yet facilitating the sliding of post-receiving tube 28 into position along a post without platform support mechanism 28 being in the way of such positioning. Tube mount 44 may be, for example, a releaseably attachable plate (e.g., bolted), a hinge mount, or alternate connection assembly. Such a tube mount 44 permits the positioning of first and second support extensions 36, 38 below pier platform 18 for supporting the weight thereof. (If platform support mechanism 28 were immovably mounted instead, when sliding platform height adjustment apparatus 22 down a post, first and second support extensions 36, 38 would come to rest on top of pier platform 18 and would not be positionable therebelow as needed for the present invention to operate.) At the lower end of post-receiving tube 28 and mounted on opposite sides thereof are rod-receiving cylinders 46, the function of which will be discussed later.

Base plate 30 carries height positioning mechanism 32 thereupon. Base plate 30 has a base though hole 48 therein for receiving a pier post therethrough. Also, a pair of base rods 50 are mounted on base plate 30 on opposite sides of base through-hole 48. Base rods 50 are configured for operatively mating with rod-receiving cylinders 46 associated with first-receiving tube 28. The interaction of base rods 50 with rod-receiving cylinders 46 allow the relative lateral positioning between base plate 30 and first-receiving tube 28 to be maintained during the use of platform height adjustment apparatus 22, thereby preventing rotation of tube 28 relative to base plate 30 and assuring a single degree of freedom (i.e., vertical) therebetween.

Height positioning mechanism 32 facilitates the actual lifting and lowering of pier platform 18. The upper end of height positioning mechanism 32 is attached to tube mount 44, tube mount 44 thereby providing a connection between post-receiving tube 28 and height positioning mechanism 32. The lower end thereof is attached to base plate 30. Height positioning mechanism 32 is actuateable for controlling displacement between base plate 30 and upper bracket member 52 of main bracket section 34. As base plate 30, upon which height positioning mechanism 32 is mounted, rests upon temporary support mechanism 20, actuation of height positioning mechanism 32 is effectively able to determine the height of first and second supports 36, 38 relative to temporary support mechanism 20 and thereby that of pier platform 18 also. Height positioning mechanism 32 advantageously is a lift or jack mechanism. Such a jack may be of the hydraulic, pneumatic, screw, scissor, or equivalent variety.

In operation, base plate 30, via base through-hole 48, and post-receiving tube 28 are slid down a post (e.g., first post 12) until base plate 30 comes into contact with a temporary support mechanism 20 mounted on first post 12, temporary support mechanism 20 being positioned at a location above cross-member receiver 16 on first post 12.

During the initial sliding step, platform support mechanism 26 is held out of the way until clearance to platform underside 24 can be gained for first and second support extensions 36 and 38. Such positioning should occur at the least by the time base plate 30 engages with temporary support mechanism 20. If this is not the case, temporary support mechanism 20 should be lowered to a point which will allow first and second support extensions 36, 38 to be received underneath pier platform 18.

Once first and second support extensions 36, 38 are in position below pier platform 18, height positioning mechanism 32 is actuated so as to bring first and second support extensions 36, 38 into an operatively supporting position for pier platform 18. When such engagement has occurred, platform height adjustment apparatus 22 is supporting the weight of pier platform 18 (FIG. 3) and can thereby be used to lift pier platform 18 to a new desired location, with the position of cross-member receiver 16 and associated cross-member 14 being adjusted upwardly. Conversely, once such engagement has occurred, the position of cross-member 14 and associated cross-receiver 16 could be adjusted downwardly, with pier platform 18 then being lowered using platform height adjustment apparatus 22. After the desired adjustment is made platform support mechanism 26 can be moved out of the way, allowing the remainder of the platform height adjustment apparatus 22 to be removed from the post.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pier, comprising:

at least one post including a first post, a pier platform mounted relative to each said post, said pier platform having a platform underside;

a temporary support member selectively vertically positioned upon said first post at a temporary, fixed position; and a platform height adjustment apparatus slidably mounted along said first post, said platform height adjustment apparatus being selectively capable of being moved relative to said temporary support member and resting thereupon, said platform height adjustment apparatus including a platform support member and a height positioning mechanism, said platform support member supporting said pier platform, said height positioning mechanism configured for facilitating a selective vertical positioning of said platform support mechanism and, therefore, said pier platform relative to said first post.

2. The pier of claim 1, wherein said platform support member includes at least a first support extension, said first support extension extending under said pier platform and operatively contacting said platform underside.

3. The pier of claim 2, wherein said platform support member further includes a second support extension, said second support extension being located opposite said first support extension relative to said first post, said second support extension extending under said pier platform and operatively contacting said platform underside.

4. The pier of claim 2, wherein said platform support member includes a main bracket section positioned adjacent said first post, said first support extension mounted substantially perpendicularly to said main bracket section.

5. The pier of claim 1, wherein said platform height adjustment apparatus includes a post-receiving tube mounted thereon for facilitating the slidable mounting thereof upon a given said post.

6. The pier of claim 1, wherein said height positioning mechanism is a jack apparatus.

7. The pier of claim 6, wherein said jack apparatus is one of a scissors jack, a screw jack, a hydraulic jack, and a pneumatic jack.

8. The pier of claim 1, wherein said platform height adjustment apparatus further includes a post-receiving tube and a base plate, said post receiving tube being one of hingedly mounted and selectively removably mounted to said platform support member, said base plate being slidably mounted relative to said post-receiving tube, said height positioning mechanism being mounted to said base plate and to said platform support member, said base plate resting upon said temporary support member.

9. The pier of claim 8, wherein said base plate and said platform support member are selectively separated vertically relative to one another via operation of said height positioning mechanism.

10. The pier of claim 1, further comprising a cross-member receiver positioned on said first post at a selected vertical post position relative thereto, said cross-member receiver being configured for receiving a pier cross-member therein, said cross-member receiving further being configured for selected vertical positioning along said first post.

11. A platform height adjustment apparatus for adjusting a height of a pier platform relative to a pier support structure, the pier support structure including at least a first pier post, the first pier post having a temporary support member mounted thereon, said platform height adjustment apparatus comprising:

a post-receiving tube configured for facilitating the slidable mounting thereof upon the first post;

a platform support member configured for supporting said pier platform, said post-receiving tube being one of hingedly mounted and selectively removably mounted to said platform support member; and a height positioning mechanism configured for facilitating a selective vertical positioning of said platform support mechanism and thereby capable of adjusting a position of the pier platform relative to the first post.

12. The platform height adjustment apparatus of claim 11, wherein said platform support member includes at least a first support extension, said first support extension for operatively extending under the pier platform.

13. The platform height adjustment apparatus of claim 12, wherein said platform support member further includes a second support extension, said second support extension being located opposite said first support extension relative to said first post, said second support extension for operatively extending under the pier platform.

14. The platform height adjustment apparatus of claim 12, wherein said platform support member includes a main bracket section positionable adjacent said first post, said first support extension mounted substantially perpendicularly to said main bracket section.

15. The platform height adjustment apparatus of claim 11, wherein said height positioning mechanism is a jack apparatus.

16. The platform height adjustment apparatus of claim 15, wherein said jack apparatus is one of a scissors jack, a screw jack, a hydraulic jack, and a pneumatic jack.

17. The platform height adjustment apparatus of claim 16, wherein said base plate and said platform support member are selectively separated vertically relative to one another via operation of said height positioning mechanism.

18. The platform height adjustment apparatus of claim 11, further including a base plate slidably mounted relative to said post-receiving tube, said height positioning mechanism being mounted to said base plate and to said platform support member, said base plate being configured for resting upon the temporary support member.

19. A method of adjusting a height of a pier platform relative to a pier structure, the pier structure including at least a first post, the method comprising the steps of:

providing a platform height adjustment apparatus, the a platform height adjustment apparatus including a platform support member and a height positioning mechanism;

slidably mounting a platform height adjustment apparatus on the first post;

fixing a post position of said platform height adjustment apparatus relative to the first post, the post position being situated above and proximate the pier platform, the post position being established via a temporary support member selectively vertically positioned upon the first post at a temporary, fixed position, said platform height adjustment apparatus being selectively capable of being moved relative to said temporary support member and resting thereupon;

moving said platform support member into a platform supporting position relative to the platform; and actuating said height positioning mechanism to thereby one of lower and lift the pier platform.

* * * * *